United States Patent [19]

Brungardt

[11] Patent Number: 4,908,044

[45] Date of Patent: Mar. 13, 1990

[54] SEMI SOLID ETHANOL BASED FUEL

[75] Inventor: Trueman A. Brungardt, Loveland, Colo.

[73] Assignee: T.A.V., Inc., Greeley, Colo.

[21] Appl. No.: 342,745

[22] Filed: Apr. 25, 1989

[51] Int. Cl.[4] ..... C10L 7/00

[52] U.S. Cl. ..... 44/7.6; 44/7.7

[58] Field of Search ..... 44/7.6, 7.7

[56] References Cited

U.S. PATENT DOCUMENTS

| | | | |
|---|---|---|---|
| 3,401,027 | 9/1968 | Dreher et al. | 44/7.6 |
| 3,437,464 | 4/1969 | Maloney | 44/7.7 |
| 3,759,674 | 9/1973 | Gregg et al. | 44/7.6 X |
| 3,807,973 | 4/1974 | Iwama et al. | 44/7.6 X |
| 4,406,664 | 9/1983 | Burgess et al. | 44/7.7 X |
| 4,436,525 | 3/1984 | Zmoda et al. | 44/7.3 |
| 4,575,379 | 3/1986 | Browning | 44/7.6 |

*Primary Examiner*—Peter A. Nelson
*Attorney, Agent, or Firm*—David S. Woronoff

[57] ABSTRACT

A solid or semi-solid fuel produced entirely from vegetable products having an approximate formulation of 86.1% ethanol, 2.2% water and 11.7% sodium salts of fatty acids produced by virtually any commercially available process for producing ethanol from vegetable crops such as cane sugar, beet sugar, wheat, pineapple, corn and the like which also produces "sweetwater" which contains fatty acids, sugar water and fibrous plant material in which the sweetwater is mixed with the ethanol in a reactor which heats the mixture to a temperature of 110–140 degrees fahrenheit wherein the mixing is performed in two stages by two reactors in which the first reactor rotates at between 750–1800 r.p.m. for from five to seven minutes and the second reactor rotates at between 2200–3100 r.p.m. for about five to seven minutes.

10 Claims, 3 Drawing Sheets

SEMI SOLID ETHANOL BASED FUEL

FIELD OF THE INVENTION

The present invention relates to the invention of a semi-solid fuel based on alcohols produced from vegetable products such as corn, wheat, sugar cane and others which can be fermented to produce an alcohol. The invention also relates to the process for producing the inventive products.

There are many patents which teach inventions relating to solid or semi-solid hydro-carbon fuels. Some related patents are U.S. Pat. Nos. 1,581,001, 1,844,754, and 3,964,880. None of these patents teach either the product or the process of the present invention or anything particularly close to the present inventive product or process in structure or function Products currently available range from Sterno (a registered trademark of Colgate Co.) to napalm which is used by military forces around the world. While these products are useful in one way or another, they all have serious defects. Sterno, for example, is too volatile for safe use in many environments. The nation's largest scouting organizations either prohibit or restrict the use of Sterno as a cooking fuel on scout outings. In addition, sterno has a relatively short shelf-life because of its high volatility. Sterno tends to burn with a colorless flame which leads to potentially dangerous situations.

Other solid or semi-solid fuels are well known as starters for charcoal fires or as wood fire-place fire starters. These products generally burn with some unpleasant residue and, once started, are difficult. if not impossible to extinguish and then re-use.

The general public, the scouting world and the military, among others, have long sought a solid or semi-solid fuel which is non-volatile, environmentally safe having no hazardous residual wastes, has long shelf-life, can be easily started and safely stopped and which burns with a visible color and essentially no residue.

SUMMARY OF THE INVENTION

The present inventive product relates to a novel solid or semi-solid fuel produced entirely from vegetable product. The present inventive products is a semi-solid alcohol based fuel having an approximate formulation of 86.1% ethanol, 2.2% water and 11.7% sodium salts of fatty acids.

The inventive process for producing the inventive product utilizes virtually any commercially available process for producing ethanol from vegetable crops such as cane sugar, beet sugar, wheat, pineapple, corn and the like. The commercially available processes all produce a by-product known as "sweetwater" which contains fatty acids, sugar water and fibrous plant material. The sweetwater is mixed with the ethanol in a reactor which heats the mixture to a temperature of between 110–140 degrees fahrenheit. The mixing is performed in two stages by two reactors. The first reactor rotates at between 750–1800 r.p.m. for from five to seven minutes. The second reactor rotates at between 2220–3100 r.p.m. for about five to seven minutes.

BRIEF DESCRIPTION OF THE DRAWINGS

FIG. 4 shows a flow chart showing the novel steps which form a part of the present inventive process.

DESCRIPTION

The present inventive processes and products are most easily understood by referring to FIG. 4 which is a flow chart showing the basic inventive steps for producing the inventive product.

Figure 1:
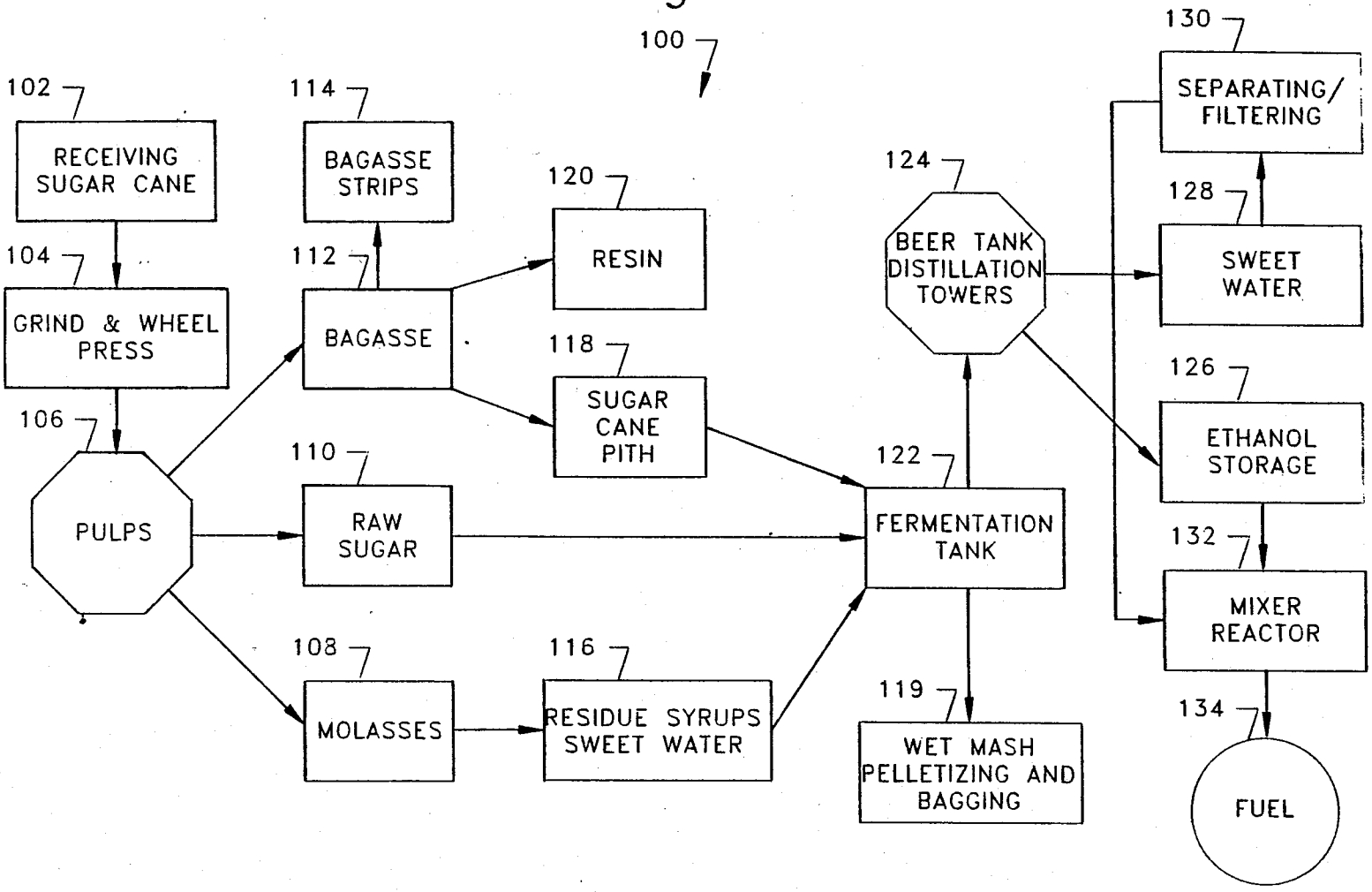
FIG. 1 shows a flow chart of a commonly used process for producing ethanol from cane sugar modified to show one embodiment of the present inventive process for producing the present inventive product.
Figure 2:
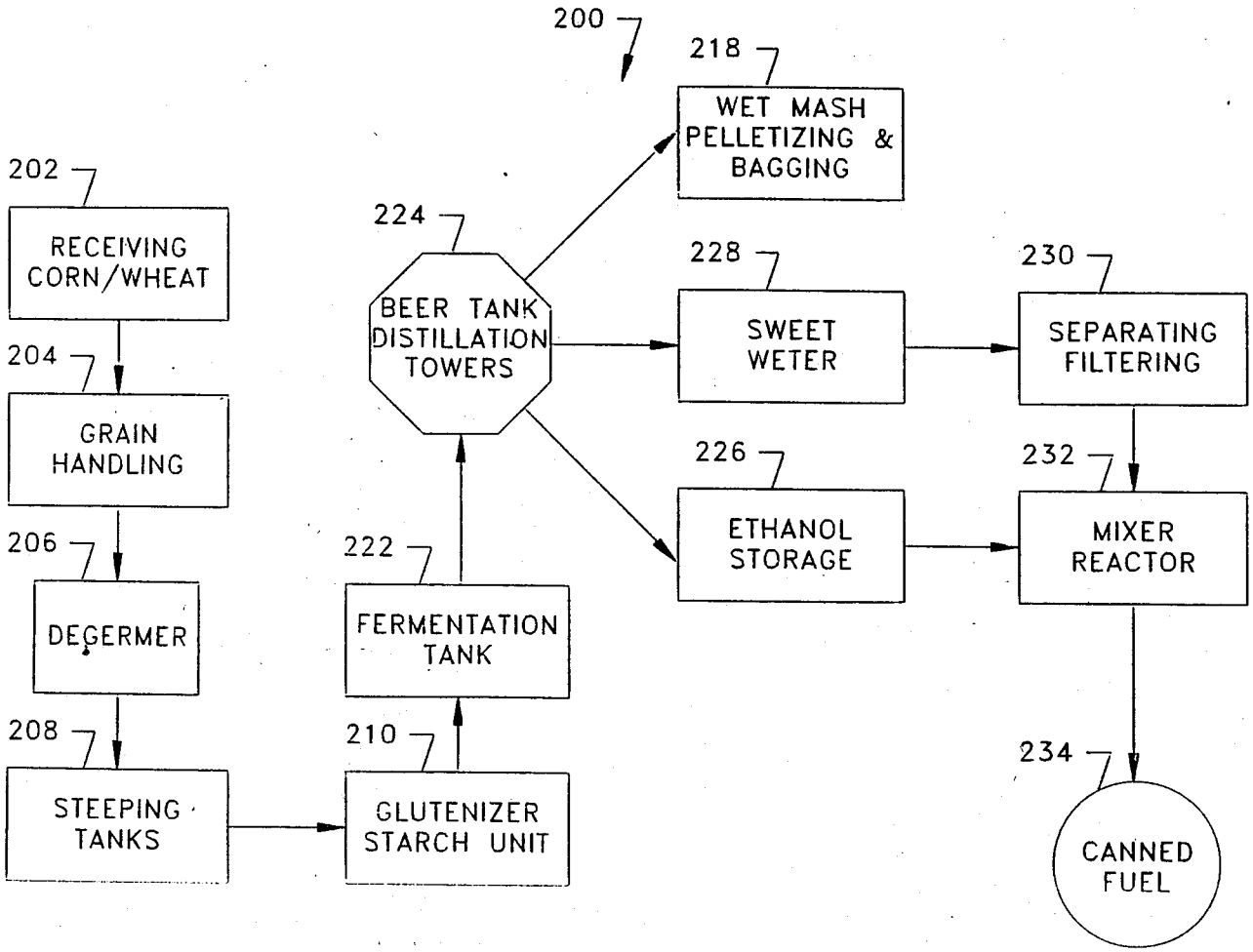
FIG. 2 shows a flow chart of a commonly used process for producing ethanol from corn modified to show a second embodiment of the present inventive process for producing the present inventive product from corn.
Figure 3:
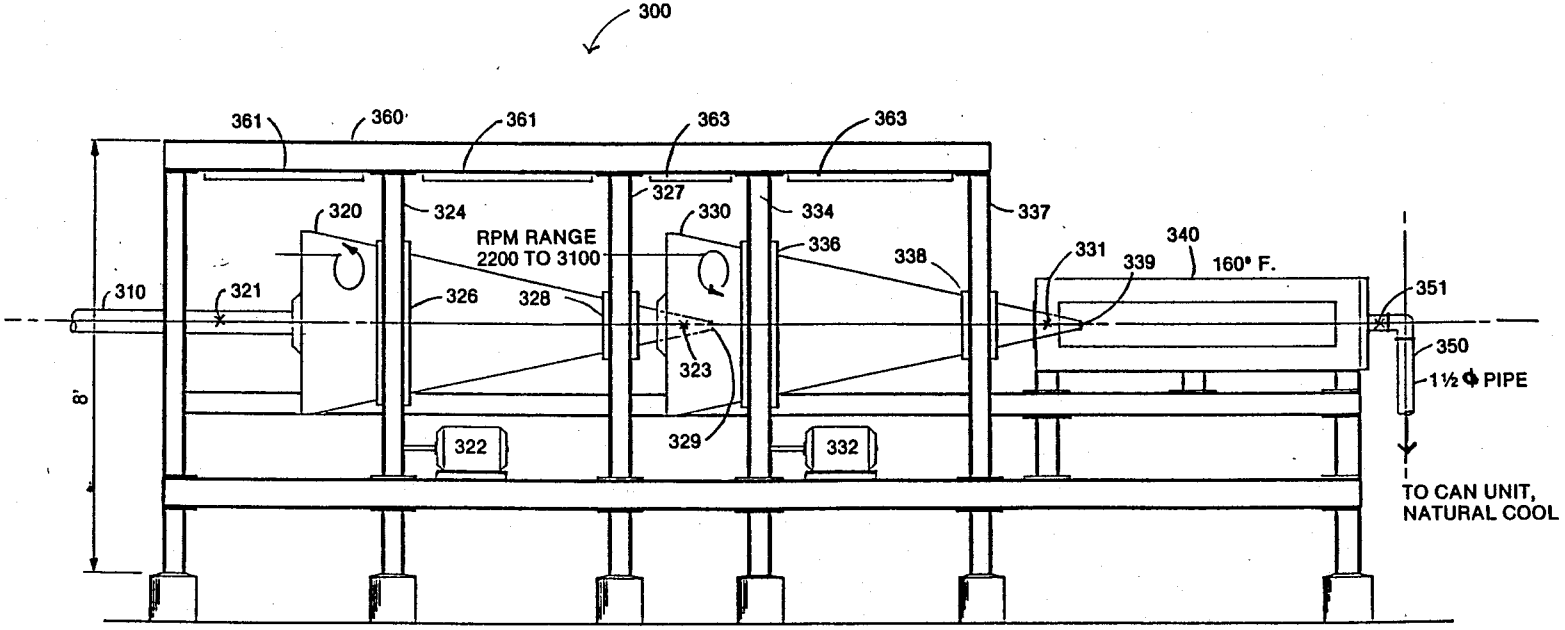
FIG. 3 shows a top view of a mixing chamber reactor section for producing the inventive product from the inventive process.

Step 1, shown by block 1, is to produce ethanol from any well-known agricultural product such as wheat, corn, cane sugar, beet sugar, rice and the like by any commercially available process. Such process will be shown in more detail in FIGS. 2 and 3. The equipment necessary to perform the process steps shown in FIGS. 1,2 and 3 is shown in two lists attached to this application as Appendix "A" and Appendix "B". Appendices "A" and "B" show commercially available equipment which can be used to perform the specific functions shown in FIGS. 1 and 2 respectively.

The ethanol producing process now in use all produce a by-product known as "sweetwater" which contains fatty acids, sugar water and fibrous plant material. The production of sweetwater is shown by blocks 128 and 228 in FIGS. 1 and 2 respectively.

Step 2, shown in block 2, is to mix the ethanol with the sweetwater in a volume ratio of 6 to 1 at a temperature of between 110–140 degrees fahrenheit for between five to seven minutes in a first centrifugal mixing chamber rotating at between 750–1800 r.p.m.

Step 3, shown in block 3, is to mix the ethanol with the sweetwater in a volume ratio of 6 to 1 at a temperature of between 110–140 degrees fahrenheit for a time of about five to seven minutes in a second centrifugal mixing chamber rotating at between 2200–3100 r.p.m.

Step 4, shown in block 4, is to remove the mixture to a heater for from one to three minutes to raise its temperature to 160 degrees fahrenheit and then draw the mixed ethanol and sweet water off to its containers where it will solidify upon cooling.

The product thus produced contains only vegetable material and comprises a semi-solid alcohol based fuel having an approximate formulation of 85.1% ethanol, 2.2% water and 11.7% sodium salt of fatty acids. The pH of the product in deionized water is 11.5 which is lower than that requiring a hazardous warning label.

Spectographic analysis of the ash produced from burning a sample of the product made from sugar cane shows that sodium is the largest element present at about 1.24% by weight. Potassium is present at about 15 parts per million. Aluminum is present at about 210 parts per million. Present in lesser amounts are silicon, lithium, nickel, lead, tin and traces of iron and magnesium.

Analysis indicates that the inventive product contains some hydroxide and some carbonate and bicarbonate or only bicarbonate ions.

Ethanol and fatty acids of the type contained in the inventive product are normally not a compatible mixture. The mechanism which produces the stable mixture is not understood at the time of making this application.

Equally unclear is what is the nature of the combustion obtained. Is it the ethanol or the fatty acid salts which are burning? Are the fatty acid salts an efficient thixatrope? The answers to these questions are presently unknown.

FIG. 1 is a flow chart depicting the basic process steps for making ethanol and also showing the inventive modifications necessary to produce the inventive fuel.

The number 100 shows the basic process in which sugar cane is received, 102, ground and processed at 104, and then turned into a pulp, 106. Molasses is produced from the pulp 108. The pulp is turned into raw sugar, 110, and the molasses into syrups and sweetwater, 116, and both products are fed to a fermentation tank, 122, and then to distillation towers, 124. The ethanol and sweetwater produced by the distillation towers are then sent to two separate storage tanks, 126 and 128. The sweetwater is then filtered to remove the fibrous residue and then sent along with the ethanol from the storage tank to a mixer-reactor unit 132 described in more detail in connection with the description of FIG. 3. The inventive product is the output of the mixer-reactor 132.

The number 200 shows the basic process in which corn is received, 202, processed at 204, and then turned to a degermer, 206. The degermed corn is then steeped 208. From the steeping tanks, the processed corn is passed to a glutenizer-starch unit, 210, and then fed to a fermentation tank, 222, and then to distillation towers, 224. The ethanol and sweetwater produced by the distillation towers are then sent to two separate storage tanks, 226 and 228. The sweetwater is then filtered to remove the fibrous residue and then sent along with the ethanol from the storage tank to a mixer-reactor unit 232 described in more detail in connection with the description of FIG. 3. The inventive product is the output of the mixer-reactor 132.

FIG. 3 shows a side view of an embodiment of the mixer-reactor shown in blocks 132 and 232 in FIGS. 1 and 2 respectively. The mixer-reactor shown generally by the number 300, has a frame 360 for supporting two rotating cones 320 and 330 which are supported for rotation by motors 322 and 332, respectively. Bearing members 326, 328, support the second cone for rotation. The motors' drive belts, 324, 334, drive the cones at speeds ranging from about 750 to about 3100 r.p.m. Pipe 310 brings the ethanol-sweetwater mixture to the first rotating cone and outlet 329 permits the mixed solution to be transformed to the second rotating cone 330. Outlet 339 permits the mixing fluid to flow to heater 340. The flow of the fluid is controlled by valves 321, 323, 331 and 351 in a conventional manner. Heater elements 361 and 363 control the temperature in mixer-reactors 320 and 330 respectively.

It can be easily seen that the present inventive process and inventive product achieve all of the stated objective and many others, as well. While the present inventive process and product have been shown and described with reference to specific embodiments, the inventions are not limited to the embodiments shown and described.

APPENDIX A

| Equipment Manufacturers (Regarding FIG. 1) | | Equipment Identification |
|---|---|---|
| 1. Inter-Cane Company Edmonton, Alberta, Canada | (104) | Grinding Unit, Wheel Press |
| 2. WINBCO Company Ottumwa, Iowa | (124, 126) | Distillation Towers, Ethanol Storage Tanks |
| 3. Gist-Brocades Watertown, Minnesota | (122) | Fermentation Tanks |
| 4. Ferro-tech Industries Wyandotis, Michigan | (119) | Pelletizing Equipment, Bagging Equipment |
| 5. John L. Bigger Company Longmont, Colorado | (130) | Filter Unit |
| 6. The Conal Corporation Denver, Colorado | (134) | Canning Machine |
| 7. Marketex Trading, Inc. Greeley, Colorado | (128, 132) | Sweet Water Separator Reactor Unit |

APPENDIX B

| Equipment Manufacturers (Regarding FIG. 2) | Equipment Identification |
|---|---|
| 1. Butler Building Systems Kansas City, Missouri (202, 204) | Grain Handling Equipment |
| 2. Buhler-Miag Company Minneapolis, Minnesota (206, 210) | Degerming Equipment, Glutenizer Unit |
| 3. WINBCO Company Ottumwa, Iowa (208, 224, 226) | Steeping Tanks, Distillation Towers, Ethanol Storage Tanks, Beer Tanks |
| 4. Gist-Brocades Watertown, Minnesota (222) | Fermentation Tanks |
| 5. Ferro-tech Industries Wyandotis, Michigan (218) | Pelletizing Equipment, Bagging Equipment |
| 6. John L. Bigger Company Longmont, Colorado (230) | Filter Units |
| 7. The Conal Corporation Denver, Colorado (234) | Canning Machine |
| 8. Marketex Trading, Inc. Greeley, Colorado (228, 232) | Sweet Water Separator Reactor Unit |

What is claimed is:

1. A semi-solid fuel comprising in combination:

86.1% by weight ethanol:

2.2% by weight water; and, 11.7% by weight sodium salt of fatty acids.

2. The product claimed in claim 1 formed by the process of:

producing ethanol from a vegetable product;

Producing sweetwater as a by-product from an ethanol producing plant;

mixing sweetwater and ethanol for a time and at a temperature of between 110–140 degrees fahrenheit in a rotating mixing vessel first at speeds of from 750–1800 r.p.m. and then at speeds of 2200 to 3100 r.p.m.

3. The product claimed in claim 1 including further about 1.24% of sodium by weight.

4. The product claimed in claim 1 including further: potassium at the rate of about 15 parts per million.

5. The product claimed in claim 1 including further aluminum at the rate of about 210 parts per million.

6. The product claimed in claim 1 wherein the sweetwater comprises in combination fatty acids, sugar water and fibrous plant material.

7. The process claimed in claim 2 wherein said mixing step is performed in two different mixing chamber of specified periods of time.

8. The process claimed in claim 2 wherein the vegetable product is chosen from the group consisting of: corn, cane sugar beet sugar, wheat, rice, pineapple.

9. The processed claimed in claim 2 including the further step of removing from the sweetwater by filtration the fibrous material before sending the sweetwater to be mixed with the ethanol.

10. The process claimed in claim 7 wherein the mixing time is from five to seven minutes.

* * * * *